US011358167B2

(12) United States Patent
Bouix et al.

(10) Patent No.: US 11,358,167 B2
(45) Date of Patent: Jun. 14, 2022

(54) REUSABLE PUMP DISPENSER

(71) Applicant: ELC MANAGEMENT LLC, Melville, NY (US)

(72) Inventors: Herve F. Bouix, New York, NY (US); Byron Jefferson Golub, Brooklyn, NY (US); Christophe Jacob, Pradons (FR)

(73) Assignee: ELC Management LLC, Melville, NY (US)

( * ) Notice: Subject to any disclaimer, the term of this patent is extended or adjusted under 35 U.S.C. 154(b) by 110 days.

(21) Appl. No.: 16/749,174

(22) Filed: Jan. 22, 2020

(65) Prior Publication Data

US 2021/0220852 A1 Jul. 22, 2021

(51) Int. Cl.

| | |
|---|---|
| ***B05B 9/08*** | (2006.01) |
| ***B05B 12/00*** | (2018.01) |
| ***A47K 5/12*** | (2006.01) |

(52) U.S. Cl.

CPC ..... *B05B 9/085* (2013.01); *A47K 5/1202* (2013.01); *A47K 5/1217* (2013.01); *B05B 12/004* (2013.01); *A45D 2200/155* (2013.01); *F25D 2331/806* (2013.01)

(58) Field of Classification Search

CPC .. B67D 1/0869; B67D 1/0857; B67D 3/0009; B05B 9/085; B05B 12/004; A47K 5/1202; A47K 5/1217; A45D 2200/155; F25D 2331/806; F25D 31/002

USPC ..... 222/146.6, 321.7, 383.1, 401; 62/3.2, 62/3.64

See application file for complete search history.

(56) References Cited

U.S. PATENT DOCUMENTS

| | | | |
|---|---|---|---|
| 2,488,591 | A | 11/1949 | Fevas |
| 3,518,410 | A | 6/1970 | Dillarstone |

(Continued)

FOREIGN PATENT DOCUMENTS

| | | |
|---|---|---|
| DE | 19839940 | 3/2000 |
| EP | 1563760 | 8/2005 |

(Continued)

OTHER PUBLICATIONS

PCT International Search Report; International Application No. PCT/US2021/014241; Completion Date: May 11, 2021; dated May 11, 2021; 15.49.

(Continued)

*Primary Examiner* — Vishal Pancholi
*Assistant Examiner* — Robert K Nichols, II
(74) *Attorney, Agent, or Firm* — Peter Giancana; Tiffany A. Johnson

(57) ABSTRACT

A reusable pump dispenser may simultaneously dispense and cool a product to a user. The product may be dispensed or dosed in predetermined and/or amounts desired by a user. The product may be cooled from an ambient temperature to a product application temperature. A cooling circuit subassembly may control the temperature, viscosity, and additional properties of the product, thereby providing a maximum benefit of the product when applied to the user. The reusable pump dispenser may eliminate microbes from the product and may provide a physical structure that may be held in a user's hand. The reusable pump dispenser may provide a reusable housing that may be easily replaced, refilled, and reused.

9 Claims, 4 Drawing Sheets

(56) References Cited

U.S. PATENT DOCUMENTS

| | | | | |
|---|---|---|---|---|
| 4,067,480 | A * | 1/1978 | Gasser | B65D 83/72 222/146.3 |
| 4,274,588 | A | 6/1981 | Schwab | |
| 4,291,685 | A | 9/1981 | Taelman | |
| 4,329,567 | A | 5/1982 | Kunz et al. | |
| 4,465,073 | A | 8/1984 | Schwob | |
| 4,538,630 | A | 9/1985 | Henderson | |
| 4,733,784 | A | 3/1988 | Bennett | |
| 4,889,440 | A | 12/1989 | Shano | |
| 5,096,319 | A | 3/1992 | Gueret | |
| 5,395,175 | A | 3/1995 | Bontoux et al. | |
| 5,513,771 | A | 5/1996 | Cote | |
| 5,556,468 | A | 9/1996 | Legrain et al. | |
| 5,572,872 | A * | 11/1996 | Hlavacek | A47G 23/04 62/3.3 |
| 5,775,344 | A | 7/1998 | Clay | |
| 5,851,079 | A | 12/1998 | Horstman et al. | |
| 5,853,010 | A | 12/1998 | Suh | |
| 5,911,226 | A | 6/1999 | Vecchiola et al. | |
| 6,009,884 | A | 1/2000 | Suh | |
| 6,454,127 | B1 * | 9/2002 | Suomela | B05B 11/0002 222/146.5 |
| 6,508,603 | B1 | 1/2003 | Vasas | |
| 6,679,908 | B2 | 1/2004 | Shimizu | |
| 6,832,487 | B1 * | 12/2004 | Baker | B67D 1/0868 222/146.6 |
| 6,907,750 | B2 * | 6/2005 | Suh | A47J 27/002 62/371 |
| 6,911,010 | B2 | 6/2005 | Dirks et al. | |
| 7,083,347 | B2 | 8/2006 | Marcotte et al. | |
| 7,090,420 | B2 | 8/2006 | De La Poterie et al. | |
| 7,108,438 | B2 | 9/2006 | Fontaine | |
| 7,227,108 | B2 | 6/2007 | Clothier et al. | |
| 7,322,366 | B2 | 1/2008 | Cho | |
| 7,448,814 | B2 | 11/2008 | Bouix et al. | |
| 7,465,114 | B2 | 12/2008 | Kress et al. | |
| 7,661,562 | B2 | 2/2010 | Tyrrell et al. | |
| 7,669,605 | B2 | 3/2010 | Cho | |
| 7,753,609 | B2 | 7/2010 | Bouix et al. | |
| 7,950,863 | B2 | 5/2011 | Bouix et al. | |
| 7,975,881 | B1 * | 7/2011 | Glucksman | B67D 1/0831 222/209 |
| 8,308,383 | B2 | 11/2012 | Bouix et al. | |
| 8,336,738 | B2 | 12/2012 | Bouix et al. | |
| 8,585,307 | B2 | 11/2013 | Bouix et al. | |
| 2003/0102005 | A1 | 6/2003 | Muraki et al. | |
| 2003/0106907 | A1 * | 6/2003 | Harrison | B05B 11/00444 222/383.1 |
| 2004/0096258 | A1 | 5/2004 | Kim | |
| 2004/0247367 | A1 | 12/2004 | Fontaine | |
| 2005/0013838 | A1 | 1/2005 | De La Poterie | |
| 2005/0031656 | A1 | 2/2005 | Pays et al. | |
| 2005/0244209 | A1 | 11/2005 | Gueret | |
| 2005/0258172 | A1 | 11/2005 | Gueret | |
| 2006/0032512 | A1 | 2/2006 | Kress et al. | |
| 2006/0246118 | A1 | 11/2006 | Gueret | |
| 2006/0251686 | A1 | 11/2006 | Gueret | |
| 2007/0080172 | A1 * | 4/2007 | Tyrrell | H01M 8/04216 222/146.5 |
| 2007/0206986 | A1 | 9/2007 | Gueret | |
| 2007/0286666 | A1 | 12/2007 | Bouix et al. | |
| 2008/0273911 | A1 | 11/2008 | Gueret | |
| 2008/0300529 | A1 | 12/2008 | Reinstein | |
| 2009/0020133 | A1 | 1/2009 | Gueret | |
| 2010/0005811 | A1 * | 1/2010 | Jaffe | B67D 1/0412 62/3.64 |
| 2010/0054841 | A1 | 3/2010 | Cho | |
| 2010/0086507 | A1 | 4/2010 | Gueret | |

FOREIGN PATENT DOCUMENTS

| | | |
|---|---|---|
| FR | 2891394 | 3/2007 |
| FR | 2962031 | 1/2012 |
| FR | 2975588 | 11/2012 |
| GB | 2174896 | 11/1986 |
| JP | H05192224 | 8/1993 |
| JP | 2002-028020 | 1/2002 |
| KR | 2002-0095268 | 12/2002 |
| KR | 2003-46005 | 3/2004 |
| KR | 10-0833204 | 5/2008 |
| KR | 10-2019-0020241 | 2/2019 |
| TW | 200607747 | 3/2006 |
| WO | WO-2007/114551 | 10/2007 |
| WO | WO-2015/039990 | 3/2015 |

OTHER PUBLICATIONS

PCT Written Opinion of the International Searching Authority; International Application No. PCT/US2021/014241; Completion Date: May 11, 2021; dated May 11, 2021; 15.49.

Minco, Thermofoil Heaters (on-line), 2005 (Retrieved on Mar. 22, 2006) Retrieved from the internet: URL: http//www.minco.com/products/heaters aspx.

PCT International Search Report: International Application No. PCT/US2007/69759; Completion Date: Dec. 28, 2007; dated Mar. 8, 2008. (05.10).

PCT International Search Report; International Application No. PCT/US2011/066229; Completion Date: Aug. 28, 2012; dated Aug. 29, 2012. (10.23C1).

PCT Written Opinion of the International Searching Authority; International Application No. PCT/US2007/69759; Completion Date: Dec. 28, 2007; dated Mar. 8, 2008 (05.10).

PCT Written Opinion of the International Searching Authority; International Application No. PCT/US2011/066229; Completion Date: Aug. 28, 2012; dated Aug. 29, 2012. (10.23C1).

Taiwan Search Report from TW Application No. 110102495.

* cited by examiner

400

500

600A

600B

REUSABLE PUMP DISPENSER

FIELD OF THE INVENTION

The present invention generally relates to dispensing systems, and more particularly, to reusable pump dispensers.

BACKGROUND OF THE INVENTION

Cosmetic cooling devices can provide massaging, cooling, and other cosmetic treatment capabilities that can be performed using a single, cooling device but can require sequentially performing multiple treatment actions or cosmetic treatment steps. For example, a cosmetic device can apply product to a surface or to a user's skin in a first step and can require cooling the surface or user's skin in a second step. Further, cosmetic cooling devices can provide bulky or large, physical structures that can be limited to a single or one-time use.

SUMMARY OF THE INVENTION

Embodiments of the present disclosure generally provide a reusable pump dispenser including a dispensing system arranged to simultaneously cool and deliver a predetermined amount of product to a user. The reusable pump dispenser may simultaneously cool and deliver the predetermined amount of product to the user, which may eliminate microbes from the predetermined amount of product. The dispensing system may control a viscosity of the predetermined amount of product during cooling and delivery of the predetermined amount of product to the user. The reusable pump dispenser may be sized and shaped to be held in a hand of the user. Further, the predetermined amount of product may be cooled from an ambient temperature to a product application temperature.

The foregoing summary is only intended to provide a brief introduction to selected features that are described in greater detail below in the detailed description. Other technical features may be readily apparent to one skilled in the art from the following drawings, descriptions and claims. As such, this summary is not intended to identify, represent, or highlight features believed to be key or essential to the claimed subject matter. Furthermore, this summary is not intended to be used as an aid in determining the scope of the claimed subject matter.

BRIEF DESCRIPTION OF THE DRAWINGS

Various exemplary embodiments are illustrated by way of example, and not by way of limitation, in the figures of the accompanying drawings in which like reference numerals refer to similar element and in which.

DETAILED DESCRIPTION OF THE INVENTION

The present disclosure generally provides a handheld, reusable pump dispenser. The dispenser may simultaneously cool and dispense fluid from a reservoir inside of the dispenser. In the following description, for purposes of explanation, numerous specific details are set forth in order to provide a thorough understanding of the disclosed embodiments. It will become apparent, however, to one skilled in the art that various embodiments may be practiced without these specific details or with an equivalent arrangement.

Figure 1:
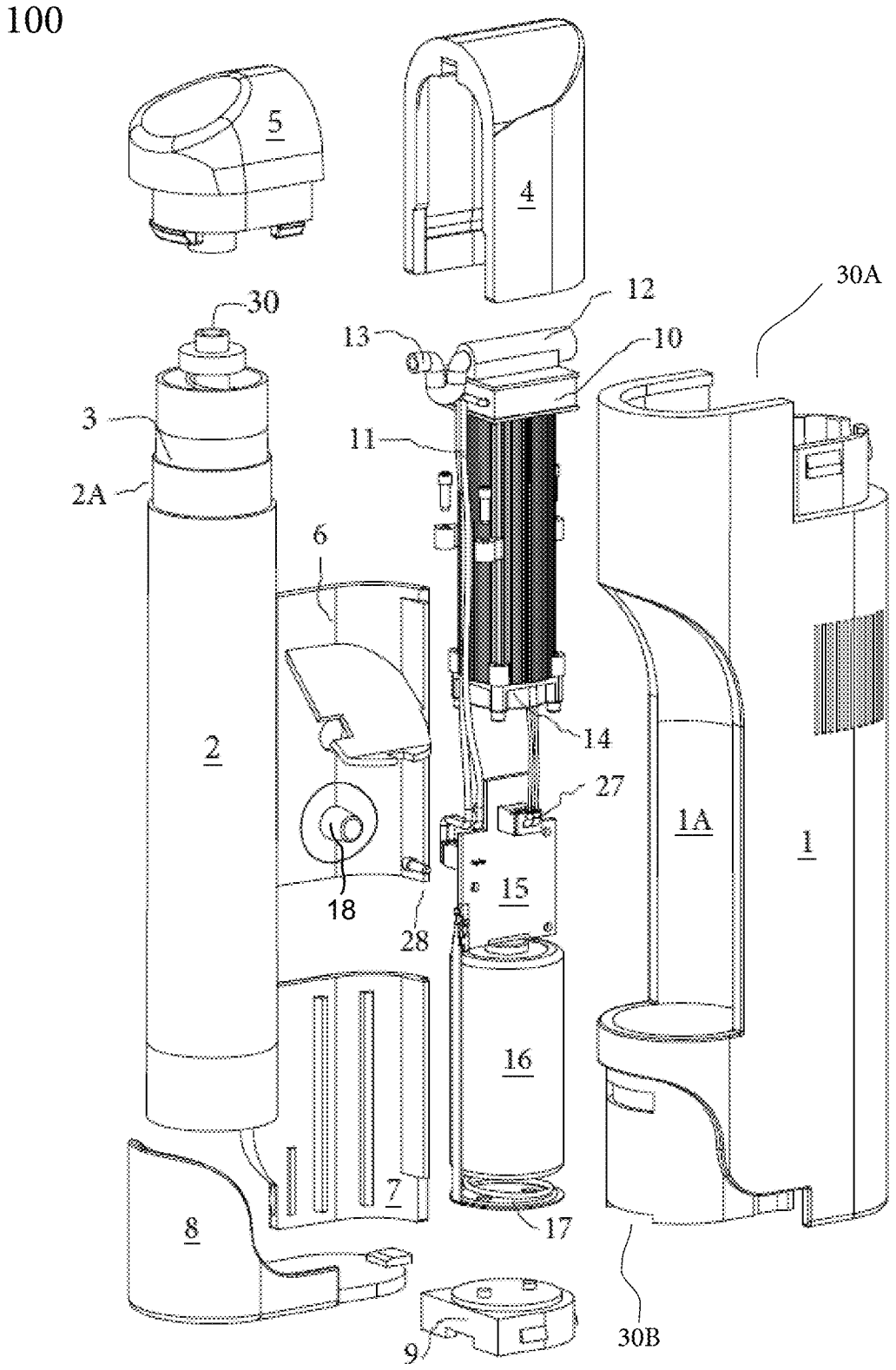
FIG. 1 depicts a reusable pump dispenser according to an embodiment of the present disclosure.

FIG. 1 depicts reusable pump dispenser 100 according to an embodiment of the present disclosure. Reusable pump dispenser 100 may be a handheld, reusable cooling dispenser that may provide reservoir 2. Reservoir 2 may be removable from reusable pump dispenser 100 and may contain a flowable product. As the product is dispensed from reservoir 2, reusable pump dispenser 100 may cool a portion of the flowable product. It should be appreciated that reusable pump dispenser 100 may cool a personal care product while the product is dispensed from reservoir 2. Reservoir 2 may provide open end 2A toward top end 30A of housing 1, which may become filled with the flowable product. Dispensing pump 3 may be provided on top of or seated above reservoir 2, and dispensing pump 3 may seal open end 2A. Reusable pump dispenser 100 may provide reusable housing 1 that may provide reservoir housing 1A and may house power source 16. Actuator 5 may be arranged proximate an end of housing 1 and may actuate dispensing pump 3 and stem 30. It should be appreciated that reusable housing 1 may provide a plurality of grooves or a grid for electric fan 14 to evacuate heat from aluminum heatsink 11. Plug 6 may be welded onto housing 1 and may be made of plastic. It should be appreciated that elastomer push button 18 and a reflector may be integrated with plug 6. Plug 6 may provide a protrusion that may help blow heated air produced past electric fan 14 to the plurality of grooves or grid provided about reusable housing 1. Base 9 and bottom cover 8 may be provided proximate bottom end 30B of housing 1 to lock or close cooling circuit subassembly 28 into housing 1. Battery door 7 may provide access into a first section of reusable housing 1, and when dispensing head 4 is otherwise not in its assembled configuration. A second section of reusable housing 1 may be accessible from the top of reusable housing 1. Cooling circuit subassembly 28 may provide a combination of flexible conduit 13, copper tube 12, and dispensing head 4. Further, cooling circuit subassembly 28 may include and connect PCB 15, aluminum heatsink 11, electric fan 14, Peltier element 10, copper tube 12, power source 16, and metal strip 17. Welded connector 27 may be provided to connect electric fan 14 with PCB 15.

Figure 2:
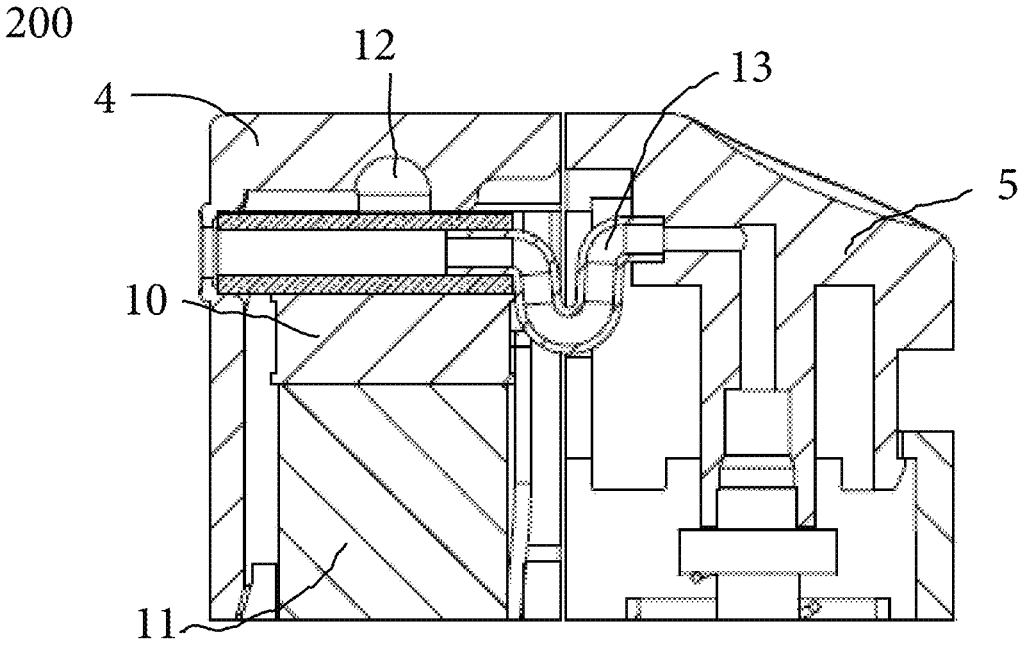
FIG. 2 depicts a cooling circuit according to an embodiment of the present disclosure.

FIG. 2 depicts cooling circuit 200 according to an embodiment of the present disclosure. Cooling circuit subassembly 28 (FIG. 1) may provide actuator 5, flexible conduit 13, copper tube 12, and dispensing head 4. Cooling circuit subassembly 28 may provide Peltier element 10 proximate aluminum heatsink 11. Peltier element 10 may provide a Peltier effect or a refrigeration technique to thermally control product within reusable pump dispenser 100 (FIG. 1).

Figure 3:
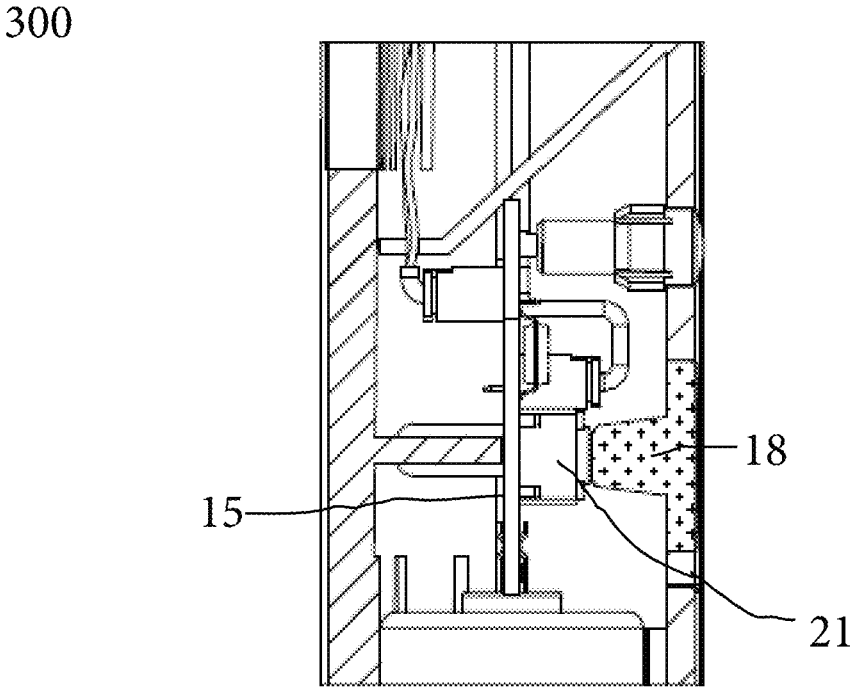
FIG. 3 depicts a push button assembly according to an embodiment of the present disclosure.

FIG. 3 depicts push button assembly 300 according to an embodiment of the present disclosure. Push button assembly 300 may provide elastomer push button 18, PCB 15, and tactile switch 21. Push button 18 and reflector may be integrated with plug 6 (FIG. 1). Push button 18 may surmount tactile switch 21 which may provide an on/off switch for the user. Tactile switch 21 may have at least two positions that may designated as the on/off position for the user. In the on position, the electrical cooling circuit may form a closed electrical loop; and, in the off position, the electrical cooling circuit may be open.

Figure 4:
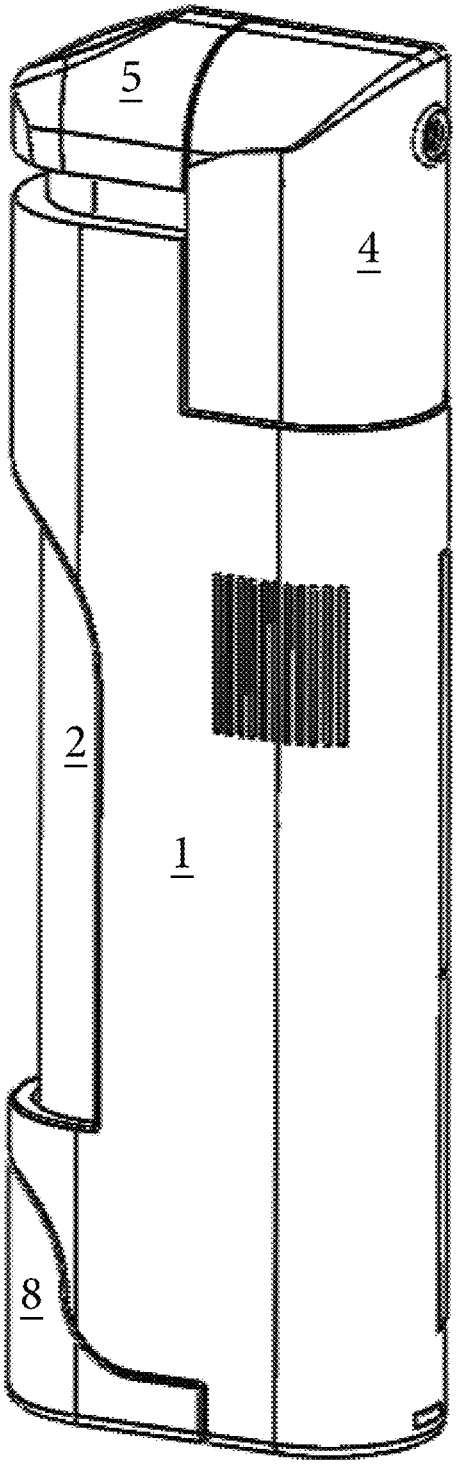
FIG. 4 depicts a perspective view of a closed or assembled reusable pump dispenser according to an embodiment of the present disclosure.

FIG. 4 depicts closed or assembled, reusable pump dispenser 400 according to an embodiment of the present disclosure. Closed, reusable pump dispenser 400 may provide housing 1 and reservoir or container 2 that may fit inside a portion of housing 1. Bottom cover 8 may secure components within housing 1, and dispensing head 4 and actuator 5 may form a top of reusable pump dispenser 400.

Figure 5:
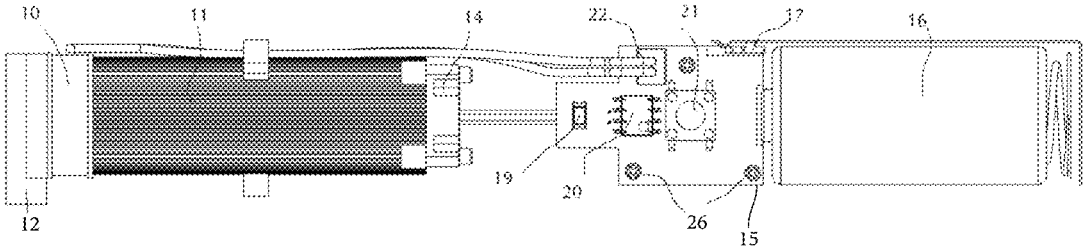
FIG. 5 depicts an interior view of a reusable pump dispenser including a printed circuit board (PCB) according to an embodiment of the present disclosure.

FIG. 5 depicts PCB assembly 500 including components of PCB 15 within reusable pump dispenser 100 (FIG. 1) according to an embodiment of the present disclosure. PCB 15 may provide CPU 20 and light-emitting diode (LED) 19. LED 19 may be controlled by CPU 20 and may alert the user when reusable pump dispenser 100 provides the correct temperature for effective usage. PCB 15 may provide a negative contact for the battery and a positive contact that may connect the negative battery electrode via negative metal strip 17. Tactile switch 21 may be located on PCB 15 to command the on/off status of reusable pump dispenser 100. Welded connector 22 may plug an electrical wire of Peltier element 10 into PCB 15. PCB 15 may provide apertures or holes for assembling PCB 15 with metal screws 26 in the interior of reusable housing 1 (FIG. 1). PCB 15 may be located proximate power source 16 on one end and fan 14 proximate aluminum heatsink 11 on an opposite end. Aluminum heatsink 11 may provide copper tube 12 in contact with a cold surface of Peltier element 10.

Figure 6A:
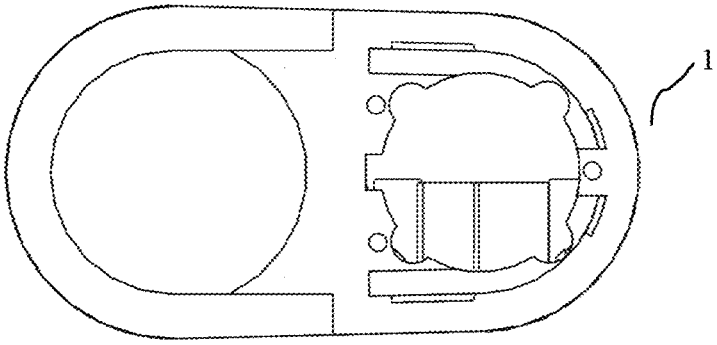
FIG. 6A depicts a top view of a reusable pump dispenser according to an embodiment of the present disclosure.
Figure 6B:
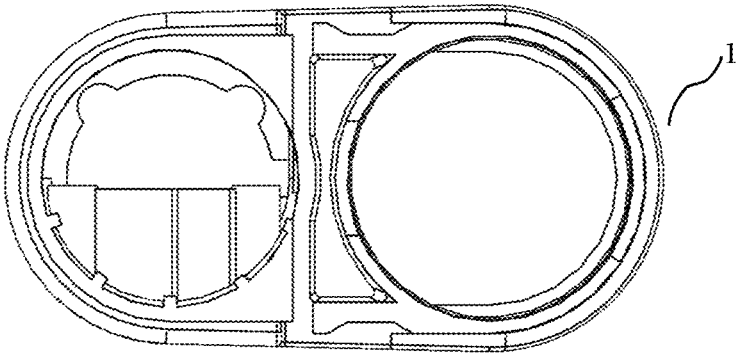
FIG. 6B depicts a bottom view of a reusable pump dispenser according to an embodiment of the present disclosure.

FIGS. 6A and 6B depict a top view 600A and a bottom view 600B of reusable pump dispenser 100 (FIG. 1) according to an embodiment of the present disclosure. Top view 600A and bottom view 600B may depict a shell of housing 1 (FIG. 1). The shell or top view 600A and bottom view 600B may be made of a material capable of insulating the product contained in reservoir or container 2 (FIGS. 1 and 4).

Reservoir

Reservoir 2 may hold a flowable product and may provide open end 2A that may become filled with the flowable product. Reservoir 2 may be inserted into reservoir housing 1A of reusable housing 1, and reservoir 2 may form a snap-fit or secure connection with the portion of housing 1. It should be appreciated that reservoir 2 may be removable and may have limited or no movement when inserted into reservoir housing 1A. Reservoir 2 may be rigid, collapsible, and/or provide a piston. It should be appreciated that reservoir 2 may be rigid and made of plastic. It should also be appreciated that reservoir 2 and reservoir housing 1A may form a cylindrical male-female connection. It should further be appreciated that reservoir 2 may be made of any material. Reservoir 2 and reservoir housing 1A may each have any shape that may together form a secure male-female connection. It should be appreciated that reservoir 2 may be collapsible and may be made of plastic, foil, paper, and/or other materials without departing from the present disclosure. Reservoir 2 may be arranged underneath or seated against dispensing pump 3 thereby forming a liquid-tight connection. It should be appreciated that snap fitments or screw threads may secure reservoir 2 with dispensing pump 3.

Dispensing Pump

Dispensing pump 3 may be arranged above reservoir 2. It should be appreciated that dispensing pump 3 may be a cosmetic or personal care dispensing mechanism. It should also be appreciated that dispensing pump 3 may be a mechanical metering pump that may provide dosing. It should further be appreciated that dispensing pump 3 may be an airless pump. Dispensing pump 3 may be connected to reservoir 2 which may provide a piston, and user actuation may prompt dispensing pump 3 to dose the flowable product. It should be appreciated that dosing the flowable product may require user actuation. A portion of dispensing pump 3 may be received in open end 2A of reservoir 2. Another portion of dispensing pump 3 may form a liquid-tight seal around open end 2A of reservoir 2. Dispensing pump 3 may be sealed with reservoir 2 by utilizing snap fitments, screw threads, and/or other attachment mechanisms. Stem 30 may extend from dispensing pump 3 and may provide an orifice. The flowable product may flow or rise through stem 30 and out of the orifice. Stem 30 may communicate with actuator 5 and may form a liquid-tight connection or fit. It should be appreciated that stem 30 may form a friction-fit with an inlet opening of actuator 5, and actuation of dispensing pump 3 may be achieved by depressing actuator 5. It should also be appreciated that actuator 5 may prompt stem 30 to move downward and may pressurize the flowable product within a chamber of dispensing pump 3. It should further be appreciated that a port may open through which pressurized product may flow into stem 30, through the orifice of stem 30, and into actuator 5. It should be appreciated that metered dosing dispensers may be utilized and may cool dispensed product more efficiently without departing from the present disclosure. It should also be appreciated that an airless dispenser may be utilized, in which an airless pump may be combined with a cylindrical container that may provide a piston.

Actuator 5 may be provided to actuate dispensing pump 3 (FIG. 1). Actuator 5 may be arranged proximate top end 30A of housing 1 (FIG. 1) and may provide a channel that may extend from an actuator inlet to an actuator outlet or exit orifice. The channel may be dedicated to routing the flowable product after being released from dispensing pump 3. Actuator 5 may provide liquid-tight, fluid communication with stem 30 (FIG. 1). It should be appreciated that dispensing pump 3 may be removed from stem 30 without departing from the present disclosure. A section of housing 1 may be accessed from top end 30A of housing 1 when actuator 5 is not arranged in its assembled position or before actuator 5 is inserted into the assembled position. Actuator 5 may slide up and down over a distance that may be controlled by a stroke of dispensing pump 3. Dispensing pump 3 may be actuated by depressing actuator 5 and may cause stem 30 to move downward. Motion of stem 30 may be achieved by depressing actuator 5. Downward movement of stem 30 may pressurize the flowable product in a chamber of dispensing pump 3. Stem 30 may open a port through which the pressurized product may flow into stem 30 through the stem orifice and into actuator 5. It should be appreciated that actuator 5 may define a product flow path. The product flow path may provide an actuator inlet, actuator channel, and an actuator orifice. It should also be appreciated that intermediate channels may be defined between portions of the product flow path. The actuator orifice may communicate via flexible conduit 13 with copper tube 12 that may be provided by dispensing head 4. The pressurized product may emerge from the actuator orifice and may eventually enter dispensing head 4.

Dispensing Head

Dispensing head 4 may be located proximate top end 30A of reusable housing 1. Dispensing head 4 may be attached to reusable housing 1 and may retain dispensing head 4 in place or in a static position during normal operation of reusable pump dispenser 100. Preferably, dispensing head 4 will remain static and may not move during normal operation of reusable pump dispenser 100 and/or relative to reusable pump dispenser 100. It should be appreciated that dispensing head 4 may not move when actuator 5 moves up and down. Optionally, dispensing head 4 may be removable from reusable housing 1. Before dispensing head 4 is arranged in its assembled configuration, or when dispensing head 4 is otherwise not in its assembled configuration, a section of reusable housing 1 may be accessible from top end 30A of reusable housing 1. Copper tube 12 may be in contact with a cold surface of Peltier element 10 and a conductive resin may be located therebetween. In order to convey the pressurized product from a moving actuator 5 to a stationary dispensing head 4, flexible conduit 13 may be provided. Flexible conduit 13 may provide a first end that may be in fluid communication with an exit orifice of actuator 5. A first end of flexible conduit 13 may move up and down with actuator 5. Flexible conduit 13 may provide a second end that may be in fluid communication with the copper tube 12 of dispensing head 4. The second end of flexible conduit 13 may be stationary. An end of flexible conduit 13 may form a friction fit into an exit orifice of actuator 5 or an inlet of dispensing head 4. It should be appreciated that other connection mechanisms may be utilized. It should also be appreciated that actuator 5 and dispensing head 4 may be proximate or immediately adjacent one another, so as to form an appearance of a single, uniform component. Flexible conduit 13 may span between actuator 5 and copper tube 12. Dispensing head 4 may provide a space inside actuator 5 and/or dispensing head 4 in which flexible conduit 13 may reside.

Conduit

Conduit 13 may be flexible and may bend to desired angles. Desired angles may allow actuator 5 to travel up and down reusable pump dispenser 100 without restriction. Conduit 13 may be made of materials strong enough to flex or bend, while a lumen provided inside conduit 13 may not be significantly restricted. Conduit 13 may flex enough to prevent product flow from being significantly hindered. Preferably, conduit 13 may be a flexible plastic tube. It should be appreciated that conduit 13 may be made of other materials without departing from the present disclosure. An overall flow path may be defined by a flow path through mechanical pump 3, another flow path through actuator 5, conduit 13, copper tube 12, and an additional flow path through dispensing head 4. Preferably, at each connection along the flow path, the connections between components are fluid-tight. A fluid-tight connection may prevent flowable product from leaking out of the overall flow path and may also prevent product form being exposed to the air, thereby preventing the flowable product from drying or loosing moisture.

Cooling Circuit

Reusable pump dispenser 100 may provide an interruptible electric cooling circuit. The interruptible electric cooling circuit may provide cooling circuit subassembly 28 in combination with power source 16, a means to operate electrical switch, and one or more electrical conductors. The one or more electrical conductors may carry electricity between power source 16 and PCB 15. PCB 15 may be connected to Peltier element 10 that may be provided by cooling circuit subassembly 28. It should be appreciated that cooling circuit subassembly 28 may include other elements without departing from the present disclosure. When the electrical switch is closed, current may flow to the cold generating portion, which may define the cold generating portion as being "on" or activated. When the electrical switch is opened, current may fail to flow to the cooling generating portion, which may define the cold generating portion as being "off" or deactivated. It should be appreciated that reusable pump dispenser 100 may provide additional circuits without departing from the present disclosure.

Power Source

Power source 16 may provide a source of electric current to reusable pump dispenser 100. Preferably, power source 16 may be a DC power supply. Power source 16 may be housed within a first section of the reusable housing 1 that may provide a size large enough to accommodate power source 16. Power source 16 may provide at least one positive terminal and at least one negative terminal. The positive and negative terminals may form part of an afferent path (away from the power or current source) and an efferent path (toward the power or current source), respectively. One or more terminals of power source 16 may directly contact a conductive element on PCB 15 and/or one or more electrical leads may intervene with the conductive element. It should be appreciated that the one or more electrical leads may be a lead, spring, or another conductive component without departing from the present disclosure. When the cooling circuit is activated or "on," power source 16 may independently provide enough energy sufficient to decrease the temperature of a flowable product, as described herein. Preferably, power source 16 may provide enough energy sufficient to power reusable pump dispenser 100 without being recharged, replaced, and/or substantially decline cooling performance throughout a lifetime of a typical, full-size (i.e. non-promotional size) commercial container. It should be appreciated that the lifetime of a container may refer to the time period required for a user to extract and apply as much product as possible to a surface from the container during normal or intended use.

In a preferred embodiment, a DC power supply may provide one or more batteries. More preferably, the DC power supply may provide exactly one battery. It should be appreciated that any quantity of batteries may be provided without departing from the present disclosure. Several types of batteries may be utilized to deliver a requisite amount of power over the lifetime of the container or package and may achieve desired performance levels. Examples of battery types include, but are not limited to, zinc-carbon (or standard carbon), alkaline, lithium, nickel-cadmium (rechargeable), nickel-metal hydride (rechargeable), lithium-ion, zinc-air, zinc-mercury oxide and/or silver-zinc chemistries. Common household batteries, such as those used in flashlights and smoke detectors, are frequently found in small handheld devices. These common household batteries typically include AA, AAA, C, D and 9-volt batteries. Other batteries that may be appropriate are commonly found in hearing aids and wrist watches. It is preferable if the battery is capable of being disposed of through an ordinary, household waste-stream. Therefore, batteries which by law must be separated from normal, household waste-streams for disposal, such as, batteries containing mercury, are less preferred. In another embodiment, power performance needs of a cooling dispenser may be met by a single, non-rechargeable battery. For example, a lithium/manganese dioxide chemistry that does not to contain mercury may provide a nominal amount of 3 volts. A single, non-rechargeable battery may provide a capacity of at least 1,400 milliamp-hours (mAh). A battery may provide 1,400-1,800 mAh without departing from the present disclosure. It should be appreciated that more or less than 1,400 mAh may be nominal without departing from the present disclosure. It should also be appreciated that a nominal amount of 3 volts may be approximately 2.5-3.5 volts. It should further be appreciated that more or less than 3 volts may be nominal without departing from the present disclosure. A commercially available battery having the desired or nominal capacity and voltage may be the Energizer® 123 battery having 3 volts and 1,500mAh.

It should be appreciated that power source 16 may be replaceable or rechargeable. For example, reusable housing 1 may have a removable door or battery door 7. Battery door 7 may provide access to power source 16 in a first section. Alternatively, or in addition to being replaceable, power source 16 may be a battery that may be rechargeable. Either power source 16 may be removed from reusable housing 1, or an exterior of reusable housing 1 may be provided with electric leads to power source 16. Reusable pump dispenser 100 may be reposed in a charging base and power from the base may be transmitted to and stored in a battery. It should be appreciated that these features may be optional and implementation of power source 16 in reusable pump dispenser 100 may depend upon various factors. For example, depending on the global geographic location in which reusable pump dispenser 100 is sold and/or utilized, disposal of batteries may be governed by the respective region's regulations. In particular, the sale, use and disposal of rechargeable batteries may be subject to more demanding restrictions than non-rechargeable batteries. It should be appreciated that reusable pump dispenser 100 having a single power source 16 may be sufficient, in normal use, to provide enough power to heat cool flowable product until no further flowable product can be dispensed. It should also be appreciated that reusable pump dispenser 100 having a single power source may alleviate environmental concerns and may provide convenience to users.

Reusable Housing

Reusable housing 1 may be integrated with a cooling dispenser and may provide an elongated structure including top end 30A and a bottom end 30B. Reusable housing 1 may provide a geometry or shape that may be grasped by a user's hand. The geometry or shape may provide a structure that may be partially hollow. It should be appreciated that reusable housing 1 may have a cylindrical shape, quasi-cylindrical, or another shape without departing from the present disclosure. Further, reusable housing 1 may provide interior space that may be divided into a first section and a second section. The first section may provide enough space that may be sufficient to accommodate or house PCB 15. It should be appreciated that PCB 15 may include power source 16, and power source 16 may be one or more batteries. It should also be appreciated that PCB 15 may include negative metal strip 17, Peltier element 10, and copper tube 12 that may contact Peltier element 10 and any other support structure.

A side of reusable housing 1 may provide battery door 7. When battery door 7 is removed from reusable housing 1, access may be gained to the first section of housing 1. Through battery door 7, at least one battery or power source 16 may be inserted into or removed from the electrical cooling circuit. Tactile switch 21 may be provided and may have at least two positions that may designated as on position and off position. In the on position, the electrical cooling circuit may form a closed electrical loop, and in the off position, the electrical cooling circuit may form an open loop. Reusable housing 1 may have an opening or window, such as reservoir or container 2, that may be visible in the second section. The bottom end of reusable housing 1 may have removable cover 9. Removable cover 9 may be attached to reusable housing 1 by any suitable means that may hold removable cover 9 in place during normal operation of reusable pump dispenser 100; as such, reusable housing 1 may be easily removed, as desired by a user. When removable cover 9 is removed from reusable housing 1, access may be gained to the second section. Reservoir or container 2 and mechanical pump 3 may be combined with a second container that may include a piston. The piston may be inserted into or removed from the second section. Combining reservoir or container 2 and mechanical pump 3 may be performed in an initial factory assembly. This combination may replenish product in reservoir or container 2 and/or may supply a new reservoir with product. It should be appreciated that the cooling circuit and dispensing mechanism may be separated and may not require interaction with one another. It should also be appreciated that a design change may occur without affecting other components of reusable pump dispenser 100. For example, a design change to mechanical pump 3 may not affect operation of the cooling circuit. It should be appreciated that separating the cooling circuit from the dispensing mechanism may provide flexibility, efficiency, and cost savings associated with manufacture and assembly of reusable pump dispenser 100.

Overall dimensions of reusable housing 1 may facilitate holding the dispenser in one hand of a user, which may allow actuator 5 to be actuated by a user's finger of the same hand. For example, reusable housing 1 may provide a length of approximately 10 to 20 centimeters (cm) and a diameter of approximately 2 to 5 cm. It should be appreciated that these dimensions are merely exemplary, and reusable housing may have a length less than or greater than the aforementioned dimensions. It should also be appreciated that the dispenser is preferably a handheld dispenser that may be conveniently held or lifted in the air by a user and may be operated by one hand of a user. It should be appreciated that the weight and dimensions of reusable pump dispenser 100 may not provide an impediment to its use. When full or at capacity, reusable pump dispenser 100 may weigh less than approximately 1000 grams. Preferably, a full reusable pump dispenser 100 may weigh less than approximately 500 grams, and more preferably, less than approximately 250 grams. It should be appreciated that reusable pump dispenser 100 may weigh more and less than 1,000 grams and 100 grams, respectively. It should also be appreciated that a lower weight or mass of reusable pump dispenser 100 may provide greater ease of portability and usability.

Cooling Circuit Subassembly

Cooling circuit subassembly 28 may provide PCB 15, aluminum heatsink 11, electric fan 14, Peltier element 10, copper tube 12, power source 16, and metal strip 17. PCB 15 may be arranged inside a first section of reusable housing 1. PCB 15 may provide housing that may not move substantially relative to reusable housing 1 and may be shaped to similar the interior of the first section of reusable housing 1. PCB 15 may provide apertures or holes to assemble PCB 15 with metal screws 26 in the interior of reusable housing 1. Reusable housing 1 may provide a mechanism or structure that may receive metal screws 26 and lock PCB 15 into a desired location. It should be appreciated that securing PCB 15 to the desired location and preventing undesired motion of PCB 15 may be accomplished by utilizing other hardware or securing mechanisms.

PCB 15 may provide a substrate that may be non-conductive with normal or expected use of reusable pump dispenser 100. The substrate may be made of materials including, but not limited to, epoxy resin, glass epoxy, Bakelite or a thermosetting phenol formaldehyde resin, and/or fiberglass. The substrate may provide a thickness ranging from approximately 0.25 to 5.0 millimeters (mm), preferably 0.5 to 3 mm, and more preferably, approximately 0.75 to 1.5 mm. Portions of one or both sides of the substrate may be covered with a layer of copper. For example, the layer of copper may be approximately 35 μm thick. It should be appreciated that the cooper layer may have a thickness less than or greater than 35 μm without departing from the present disclosure. The substrate may support one or more heat generating portions, electronic components, and/or conductive elements. Among the conductive elements supported by PCB 15, electrical leads and/or terminals may be effective in connecting PCB 15 to battery 16. It should be appreciated that PCB 15 may support various elements in a preferred, but not an exclusive, embodiment. PCB 15 may provide any shape or dimensions that may provide ease of manufacturing and assembling PCB 15 housing and reusable housing 1 and may ensure that PCB 15 extends from an electric current source. The length required to extend PCB 15 to the electric current source may depend upon the overall length and design of reusable power dispenser 100.

A central processing unit (CPU) microprocessor may be utilized to program reusable pump dispenser 100 and may offer programs including, but not limited to, cooling as a function of time, temperature control, and other features. The preferred CPU may be Texas Instruments®, Mixed Signal Microcontroller MSP430G2210 with 128B of memory. An RT1 or NTC thermistor may be utilized. Preferably, the NTC thermistor may be in close proximity to the cooling elements. The NTC thermistor may be located in a space near copper tube 12 and Peltier element 10. It should be appreciated that the NTC thermistor may be arranged in any space where slight variations in ambient temperature of the space surrounding cooling elements may be capable of being detected. For example, the cool generating portion may automatically turn off after a time period ranging from approximately 30 seconds to 1 minute, or after any desired time period. It should be appreciated that an overhead timer and automatic shut off feature may be optional, and if a user fails to turn off the circuit, this feature may prevent the battery from losing power.

Cooling circuit subassembly 28 may provide a system that may actively measure the output temperature and may adjust itself to meet a desired temperature. A cooling dispenser may include a circuit that may remain "on" or activated indefinitely. The circuit may hold a desired temperature and may not overheat. Further, the circuit may provide an automatic shut-off feature may monitor of the temperature of cooling elements and reduce the amount of power usage typically provided by dispensers. The circuit may include a system for monitoring and maintaining an output voltage of the power source. For example, typically batteries are rated with a nominal voltage, such as 3 volts, but there can be variability from battery to battery and from use to use of the same battery. An optional system may be included that monitors and adjusts the output voltage, as needed. The optional system may maintain a lower tolerance of voltage than a battery typically supplies. An optional system may improve consistency in applicator performance and improved predictability of battery lifetime. It should be appreciated that reusable power dispenser 100 may be commercially feasible and may provide a higher level of precision and reliability compared to conventional dispensers.

The circuit may provide PCB 15 that may form an electronic circuit subassembly. The electronic circuit assembly may be inserted into the first section of reusable housing 1. The electronic circuit assembly may not depend upon reusable housing 1 for its structural integrity or electrical operation. Electric circuit assembly may provide cost savings and reduce errors made during manufacturing. Thus, the electric circuit assembly may provide advantages including, but not limited to, an effective, commercially feasible, aesthetically acceptable, battery-powered, and reusable cooling dispenser. The electric circuit assembly may further provide enhanced performance, reliability, and convenience compared to conventional assemblies. It should be appreciated that without the electric circuit assembly, as described herein, the creation of an electronic circuit subassembly may be considerably more difficult, more expensive, and less reliable. For the personal care market, creating an electronic circuit subassembly without PCB 15, as described herein, may make the cost of manufacture prohibitive and may provide lower quality performance.

PCB 15 may provide light-emitting diode (LED) 19 (FIG. 4) that may be controlled by CPU 20 (FIG. 4) and may alert the user when reusable pump dispenser 100 provide the correct temperature for effective usage. LED 19 may blink until Peltier element 10 lowers reusable pump dispenser 100 to a working temperature. A PMMA reflector may be assembled with plug 6 or a plastic plug of reusable housing 1 surmounted by LED 19. A light pipe may allow LED 19 to guide the light outside reusable housing 1 for easy control of reusable pump dispenser 100 by the user. PCB 15 may provide a negative contact for the battery and a positive contact that may connect the negative battery electrode via negative metal strip 17. Tactile switch 21 may be located on PCB 15 in order to command the on/off status of reusable pump dispenser 100. Elastomer push button 18 may be assembled with plug 6 of reusable housing 1 and may surmount tactile switch 21, which may provide an on/off switch for the user.

Electrical Switch

Reusable pump dispenser 100 may provide one or more electrical switches that may be on/off switches. The one or more electrical switches may be capable of alternately interrupting and re-establishing the flow of electricity between power source 16 and cooling elements. At least one of the one or more electrical switches may be an on/off switch that may be accessible from an exterior of reusable pump dispenser 100. At least one of the one or more electrical switches may be engaged, either directly or indirectly, by a user. It should be appreciated that the on/off switch may be manual and may require the user to directly engage with the switch. It should also be appreciated that conventional dispensers may not require a user to directly engage an on/off switch and may provide less user-control. Types of on/off switches that may be utilized include, but are not limited to, tactile switch toggle switches, rocker switches, sliders, buttons, rotating knobs, touch activation surfaces, magnetic switches and light activated switches. It should be appreciated that when the cooling elements provide multiple cooling output levels, multi-position switches or slider switches may be utilized. Generally, a manual switch may be located to provide accessibility, directly or indirectly, from a location about the exterior of reusable pump dispenser 100. It should be appreciated that automatic switching may be performed when cooling elements are turned on or off as a result of normal use of reusable pump dispenser 100. The user may press tactile switch 21 to activate the on position before pressing the actuator of the airless pump to dispense a single dose of flowable product. The user may press tactile switch 21 a second time to activate the off position. It should be appreciated that more than one on/off switch may be provided for reusable pump dispenser 100 without departing from the present disclosure. A first switch may be a manual switch, such as described above, and a second switch may be an automatic switch. It should be appreciated that different types of switches may be included in any order without departing from the present disclosure. It should also be appreciated that a plurality of switches may be wired and operate as a three-way switch to override an automatic switch.

Cold Generating Portion

The cold generating portion may include Peltier element 10, aluminum heatsink 11, electric fan 14, and copper tube 12. It should be appreciated that Peltier element 10 may provide a Peltier effect or a refrigeration technique to provide reliability in treating and cooling. For example, an electric cooling box is a type of Peltier device commonly utilized for research, space, and military applications to provide accuracy and reliability. Peltier element 10 may facilitate thermoelectricity, and more specifically, provide a Peltier effect. Peltier element 10 may be supplied with a current and may provide two surfaces, such as cold and hot surfaces. The object to be cooled may be placed on the cold surface, and it may be necessary to utilize a heat discharging mechanism on the opposite side of the cold surface.

It should be appreciated that product application temperature may refer to a temperature of a product that may be lower than an ambient temperature which may improve characteristics or behaviors of the product may be improved. For example, an ambient temperature may be between 20 to 25 degrees Celsius, and the product application temperature may be 15 degrees Celsius or lower, 10 degrees Celsius or lower, 5 degrees Celsius or lower, or at another temperature lower than the ambient temperature. Product characteristics or behaviors may refer to application of the product to a user's skin, hair, or other performance characteristics. Product characteristics or behaviors may also refer to an improved shelf-life of the product or a predetermined reduction in viscosity. It should be appreciated that activation of an active ingredient above a threshold temperature may also be a performance characteristic. It should also be appreciated that a longer shelf-life due to a reduction in harmful microbes in the product may be an improved product characteristic or behavior. It should further be appreciated that harmful microbes may be eliminated by simultaneously dispensing and cooling a predetermined amount of product from reusable pump dispenser 100.

It should be appreciated that reusable pump dispenser 100 may be applied to a user's face, eye, and/or to other parts of a user's body. Reusable pump dispenser 100 may be handheld and may cool at least approximately 50 μL of flowable product from an ambient temperature to a product application temperature in approximately 25 seconds or less. It should be appreciated that reusable pump dispenser may cool flowable product in approximately 15 seconds or less, 10 seconds or less, or 5 seconds or less. It should also be appreciated that more or less than approximately 5 to 25 seconds may be required to cool flowable product without departing from the present disclosure. Preferably, reusable pump dispenser 100 may cool at least approximately 100 μL of flowable product, 250 μL of flowable product, and most preferably, at least approximately 500 μL of flowable product. It should be appreciated that more or less than approximately 50 μL to 500 μL of flowable product may be cooled without departing from the present disclosure.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "approximately 40 mm."

It may be advantageous to set forth definitions of certain words and phrases used in this patent document. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A reusable handheld pump dispenser that comprises:

a Peltier element that has a cold surface; and a dispensing pump that is able to move a predetermined amount of product through a flow path when actuated by an actuator; wherein:

the flow path comprises a flexible conduit and a copper tube that is in contact with the cold surface of the Peltier element.

2. The reusable handheld pump dispenser of claim 1, wherein the predetermined amount of product is cooled from an ambient temperature to a product application temperature as it moves through the copper tube.

3. The reusable handheld pump dispenser of claim 1, wherein the dispensing pump is proximate to a dispensing head, wherein the dispensing head is attached to a reusable housing, and wherein the reusable housing retains the dispensing head in a static position when the dispensing pump is actuated by the actuator.

4. The reusable handheld pump dispenser of claim 3, wherein the reusable housing contains a reservoir of product that is arranged to be easily refilled, replaced, and reused.

5. The reusable handheld pump dispenser of claim 3, further comprising:

a cooling circuit subassembly that includes a printed circuit board (PCB) arranged inside a first section of the reusable housing; and a power source.

6. The reusable handheld pump dispenser of claim 5, wherein the PCB includes a light-emitting diode (LED) controlled by a central processing unit (CPU).

7. The reusable handheld pump dispenser of claim 5, further comprising:

one or more electrical switches to that are able to alternately interrupt and re-establish a flow of electricity between the power source and the cooling circuit subassembly.

8. The reusable handheld pump dispenser of claim 5, wherein the cooling circuit subassembly monitors and maintains an output voltage of the power source.

9. The reusable handheld pump dispenser of claim 5, further comprising:

a tactile switch extending from the PCB, the tactile switch arranged to activate an on position and an off position of the reusable handheld pump dispenser.

* * * * *